US005277075A

United States Patent [19]

Sakamoto et al.

[11] Patent Number: 5,277,075

[45] Date of Patent: Jan. 11, 1994

[54] STARTING MOTOR WITH AN INTERMEDIATE GEAR

[75] Inventors: Toshio Sakamoto, Aioi; Shuzou Isozumi, Himeji, both of Japan

[73] Assignee: Mitsubishi Denki K.K., Tokyo, Japan

[21] Appl. No.: 968,522

[22] Filed: Oct. 29, 1992

[30] Foreign Application Priority Data

Nov. 12, 1991 [JP] Japan ..... 3-101381[U]

[51] Int. Cl.[5] ..... F02N 15/02

[52] U.S. Cl. ..... 74/7 R; 290/48; 384/147; 74/7 E

[58] Field of Search ..... 74/6, 7; 290/38; 384/13, 16, 147, 291, 372, 385, 416

[56] References Cited

U.S. PATENT DOCUMENTS 3,104,918 9/1963 Horan, Jr. et al. ..... 384/147
4,974,463 12/1990 Luiki ..... 74/7 A
5,141,339 8/1992 Evans ..... 384/147 XR

FOREIGN PATENT DOCUMENTS 61-223269 10/1986 Japan ..... 290/48

*Primary Examiner*—Rodney H. Bonck
*Assistant Examiner*—David W. Laub
*Attorney, Agent, or Firm*—Sughrue, Mion, Zinn, Macpeak & Seas

[57] ABSTRACT

A starting motor with an intermediate gear wherein rotation of a rotating shaft of a DC motor is transmitted to a pinion in a one-way rotational direction by an over-running clutch, and an intermediate gear supported rotatably and forward-and-backward slidably by an intermediate shaft retained by a front bracket through a bearing and in mesh with the pinion, meshes with a ring-gear of an internal combustion engine by a forward movement thereof thereby starting the internal combustion engine, characterized by that; a storage for a lubricant is provided at a middle portion of the intermediate gear in the axial direction, which is fixed to an inner diameter portion of the intermediate gear; and dust seals are provided in a bearing with metal back supported by the intermediate shaft and at both ends of the inner diameter portion of the intermediate gear.

1 Claim, 2 Drawing Sheets

STARTING MOTOR WITH AN INTERMEDIATE GEAR

BACKGROUND OF THE INVENTION

1. FIELD OF THE INVENTION

This invention relates to a starting motor with an intermediate gear utilized in a vehicle, particularly to sealing of a bearing of an intermediate gear thereof.

2. DISCUSSION OF BACKGROUND

FIG. 3 is a longitudinal sectional diagram showing a conventional starting motor with an intermediate gear. A reference numeral 1 designates a DC motor, wherein a rotating shaft 3 is extended from an armature 2 and a field pole 6 is attached to a yoke 5 of a stator 4. A numeral 7 designates a front bracket connected to the yoke 5, which supports a front end of the rotating shaft 3 through a bearing 8.

A numeral 10 designates an overrunning clutch supported by the rotating shaft 3 slidably in the axial direction, composed as follows. A numeral 11 designates a clutch outer connected to a periphery of the rotating shaft 3 by a helical spline 9 thereby transmitting the rotation, and 12, a clutch inner to which a one-way rotation is transmitted through rollers 13 from the clutch outer 11, which is supported by the rotating shaft 3 through a sleeve bearing 19. A pinion 14 is integrally formed at a front end of the clutch inner 12. A numeral 15 designates a clutch cover fixed to the clutch outer 11 by calking through a holding plate 16, and 17, a stop ring attached to the clutch outer 11. An engaging groove 18 is formed between the stop ring and a stepped portion of the clutch outer. A numeral 20 designates a stopper attached to the rotating shaft which restrains a forward movement position of the overrunning clutch 10.

A numeral 21 designates a shift lever, an intermediate fulcrum of which is supported by the front bracket 7 and a receiving body 24 that is received by a grommet 22 attached to the yoke 5, through a compression spring 23, and a forked lower end of which engages with the engaging grooves 18 in the axial direction. An upper end of the shift lever 21 engages with a front end of a plunger of an electromagnetic switch (not shown) of the motor 1 in the axial direction and the shift lever 21 swivels around the fulcrum.

A numeral 25 designates an intermediate shaft fixed to the front bracket 7 in parallel with the rotating shaft 3, 26, a grommet inserted into a hole of the intermediate shaft of the front bracket 7, and 27, an intermediate gear supported by the intermediate shaft 25 rotatably and slidably in the axial direction, through a sleeve bearing 28 which is fixed to an inner periphery thereof, which meshes with a pinion 14. The sleeve bearing 28 is made of a non-oil-feeding sintering alloy. A numeral 29 designates a ring-like co-rotating body fixed to an outer periphery of the clutch cover 15, of which flange **29*a* engages with an engaging groove 27*a* at an outer periphery of a boss of the intermediate gear 27. The intermediate gear 27 moves forwardly and backwardly in accordance with a forward and a backward movement of the overrunning clutch 10, through the ring-like co-rotating body 29. A numeral 30 designates a ring-gear provided at a flywheel of an internal combustion engine, which meshes with the intermediate gear 27** by the forward movement thereof, thereby starting to rotate the internal combustion engine.

Next, explanation will be given to the operation. When current flows in an excitation coil of the electromagnetic switch, the plunger is drawn and swivels the shift lever 21 in the counterclockwise direction in FIG. 3. By this operation, the overrunning clutch 10 moves forwardly and is received by the stopper 20. By the forward movement of the overrunning clutch 10, the intermediate gear 27 moves forwardly by the ring-like co-rotational body 29 and meshes with the ring gear 30. Next, fixed terminals of the electromagnetic switch are closed, current flows in a circuit of the DC motor 1, the armature 2 starts rotating, the rotation of the rotating shaft 3 is transmitted to the intermediate gear 27 through the overrunning clutch 10 and the pinion 14 and the rotation is transmitted to the ring-gear 30, thereby starting up the internal combustion engine.

In the above conventional starting motor with an intermediate gear, by meshing the pinion 14 with the ring-gear 30, the sleeve bearing 28 of the intermediate gear 27 is applied with a force approximately twice as much as that in meshing a pair of gears. The sleeve bearing 28 is composed of a sintered alloy and the mechanical strength thereof is weak compared with a general bearing. Therefore, the service life thereof is shortened. Especially, in case of a means of transmitting the rotation of the armature 2 to the overrunning clutch through a planetary gear speed reducing device, the torque thereof is increased thereby further decreasing the service life of the sleep bearing 28. Furthermore, the front bracket 7 is provided with a large opening owing to the intermediate gear 27. Therefore, outside dusts are attached to the intermediate shaft 25, which invade into a bearing surface of the sleeve bearing 28 thereby damaging the bearing surface.

SUMMARY OF THE INVENTION

It is an object of the present invention to solve the problem and to provide a starting motor with an intermediate gear wherein the mechanical strength of the bearing at the inner diameter portion of the intermediate gear is large, the damage thereof is alleviated and the service life thereof is prolonged.

According to an aspect of the present invention, there is provided a starting motor with an intermediate gear wherein rotation of a rotating shaft of a DC motor is transmitted to a pinion in a one-way rotational direction by an overrunning clutch, and an intermediate gear supported rotatably and forward-and-backward slidably by an intermediate shaft retained by a front bracket through a bearing and in mesh with the pinion, meshes with a ring-gear of an internal combustion engine by a forward movement thereof thereby starting the internal combustion engine, characterized by that;

a storage for a lubricant is provided at a middle portion of the intermediate gear in the axial direction, which is fixed to an inner diameter portion of the intermediate gear; and dust seals are provided in a bearing with metal back supported by the intermediate shaft and at both ends of the inner diameter portion of the intermediate gear.

According to the present invention, the bearing with metal back supporting the intermediate gear is provided with a large mechanical strength. The filled lubricant does not leak owing to the dust seals. The invasion of dusts is prevented. The damage thereof is alleviated and the service life thereof is prolonged.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

EXAMPLE 1

Figure 1:
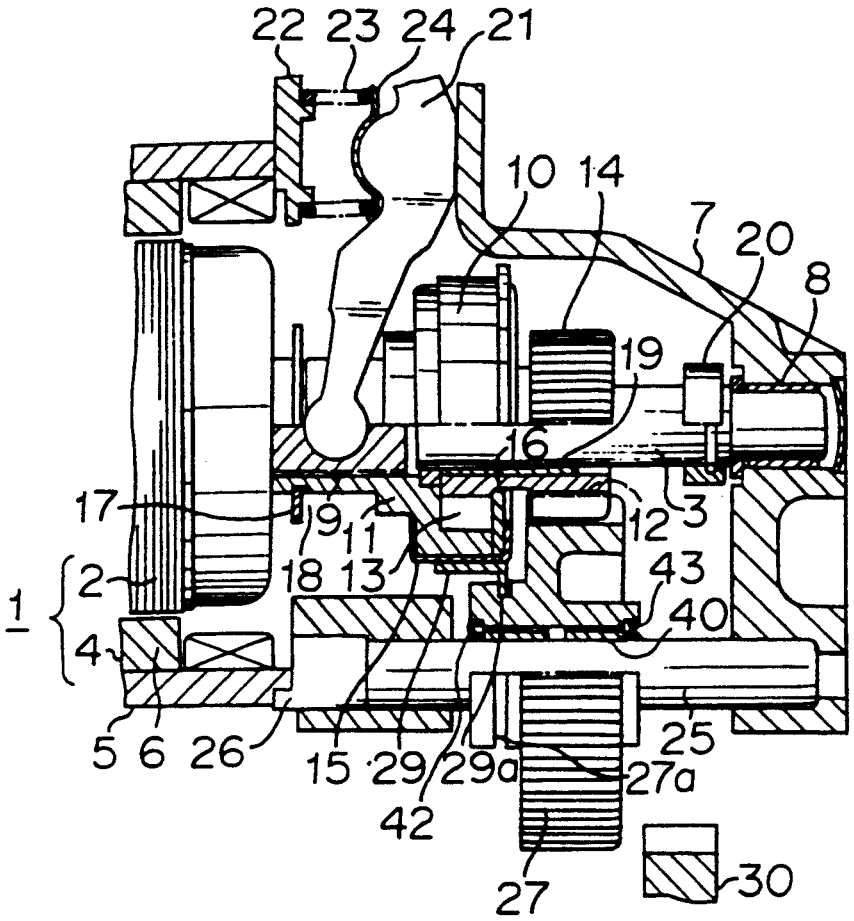
FIG. 1 is a longitudinal sectional diagram showing an important part of an embodiment of a starting motor with an intermediate gear according to the present invention.
Figure 3:
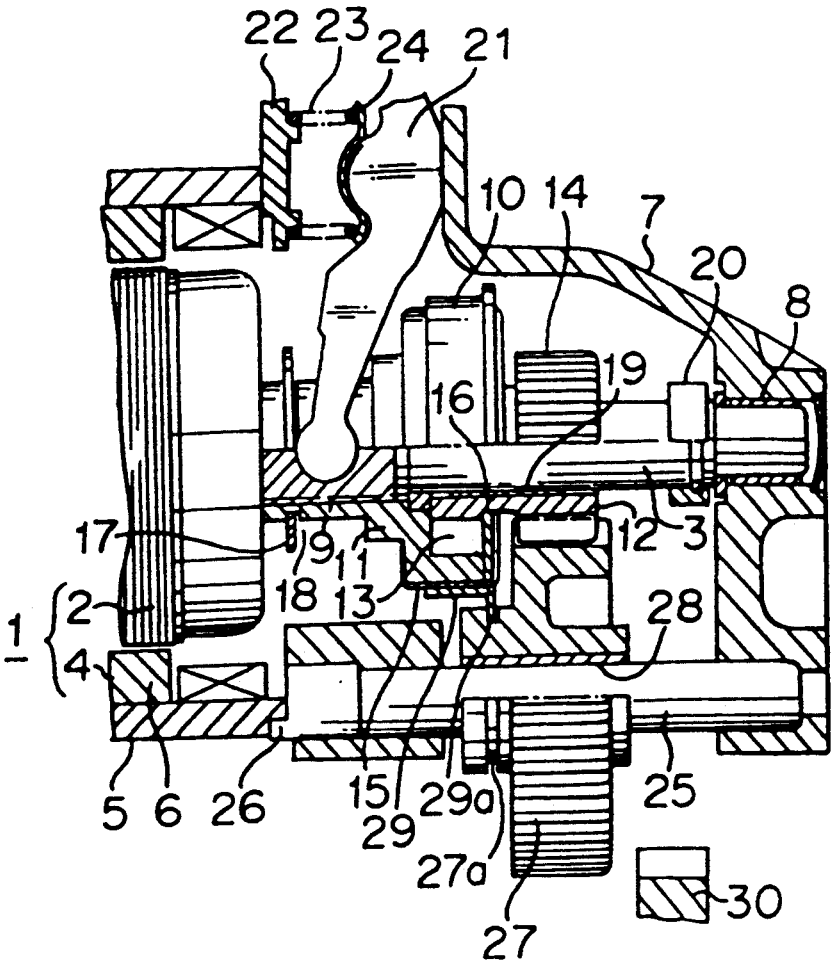
FIGURE 3 PRIOR ART
FIG. 3 is a longitudinal sectional diagram of an important part of a conventional starting motor with an intermediate gear.

FIG. 1 is a longitudinal sectional diagram of an important part of a starting motor with an intermediate gear according to the present invention, wherein notations 1 through 27, 29, 30, 27*a* and 29*a* are the same with those in FIG. 3. A numeral 40 designates a bearing with metal back fixed to an inner diameter portion of the intermediate gear 27, the mechanical strength of which is large compared with the sleeve bearing 28 composed of a conventional sintered alloy. Numerals 42 and 43 designate dust seals provided at both ends of an inner diameter portion of the intermediate gear 27, which prevent the invasion of the outside dusts and prevent leakage of a lubricant therein such as grease. As for the metal back, for instance, a steel tube, a brass tube or the like is utilized.

Figure 2:
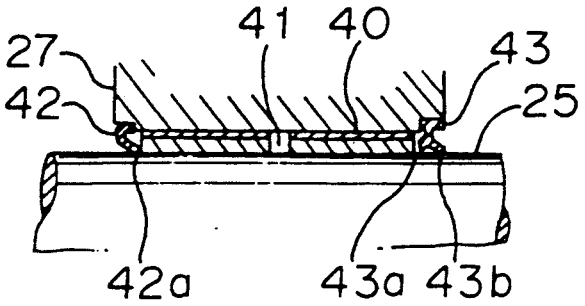
FIG. 2 is a magnified sectional diagram of an inner diameter portion of an intermediate gear fixed with a bearing with metal back of FIG. 1.

FIG. 2 is a magnified diagram showing the bearing with metal back 40 and an inner diameter portion of the intermediate gear 27 provided with the dust seals 42 and 43. The bearing 40 is divided in two in the axial direction, and between the devided portions, a storage for lubricant 41 is provided, which is filled with a lubricant such as grease. Furthermore, the bearing 40 may not be divided and may be composed of a one-piece body, and a ring-like groove is provided in the bearing metal at a middle portion thereof in the axial direction, which may be used as the storage for lubricant. The dust seal 42 is provided with a ripple 42*a* made of a gummy material at a position thereof, which seals the lubricant and prevents the invasion of dusts. The dust seal 43 is provided with ripples 43*a* and 43*b* made of a gummy material. The ripple 43*a* is extended inwardly and seals the lubricant, whereas the ripple 43*b* is extended outwardly and prevents the invasion of dusts. Moreover, the bearing may be provided with the dust seals 43 at both ends thereof.

By these dust seals 42 and 43 the invasion of dusts is prevented, the leakage of lubricant is prevented, the damage of the bearing 40 is alleviated and the service life thereof is prolonged. Especially, when a planetary gear speed reducing device is provided, a large torque is applied to the intermediate gear 27 and a large force operates on the bearing 40. However, the bearing endures the heavy load and is used with high reliability.

As stated above, according to the present invention, the bearing with metal back is fixed to the inner diameter portion of the intermediate gear, the storage for lubricant is provided at the middle portion of the bearing in the axial direction wherein the lubricant is filled and the dust seals are provided at both ends of the inner diameter portion of the intermediate gear. Accordingly, the bearing endures the heavy load of the intermediate gear, the damage thereof is alleviated and the service life thereof is prolonged.

Obviously, numerous modifications and variations of the present invention are possible in light of the above teachings. It is therefore to be understood that within the scope of the appended claims, the invention may be practiced otherwise than as specifically described herein.

What is claimed is:

1. A starter motor for transmitting rotation of a motor shaft of a motor to a ring gear of an engine, comprising:

an overrunning clutch supported on said motor shaft and slidable in an axial direction thereof;

an intermediate shaft disposed in parallel to said motor shaft;

an intermediate gear having a gear hole through which said intermediate shaft extends;

bearing means for slidably supporting said intermediate gear on said intermediate shaft so that said intermediate gear can slide in an axial direction thereof and rotate with respect thereto, said bearing means including a sleeve-like bearing member fixed in said gear hole of said intermediate gear and defining a bearing hole therein through which said intermediate shaft extends, said bearing member including a bearing portion contacting said intermediate shaft and an annular pocket portion at an axial midportion of said bearing portion and partially defined by said intermediate shaft in which lubricant is provided, a length of said bearing portion along said intermediate shaft being greater than a length of said pocket portion;

a pair of annular dust seals secured to said intermediate gear at respective opposite ends of said bearing so as to circumscribe said gear hole, said dust seals contacting said intermediate shaft to prevent dust from entering into said bearing means; and means for causing said intermediate gear to slide forwardly along said intermediate shaft in response to forward axial movement of said overrunning clutch so that said intermediate gear engages said ring gear, wherein said intermediate gear is engaged with said pinion so that rotation of said motor shaft and attendantly said pinion is transmitted to said ring gear through said intermediated gear.

* * * * *